US008358180B2

(12) United States Patent
Sugimoto et al.

(10) Patent No.: US 8,358,180 B2
(45) Date of Patent: Jan. 22, 2013

(54) HIGH FREQUENCY MODULE COMPRISING A TRANSITION BETWEEN A WIRING BOARD AND A WAVEGUIDE AND INCLUDING A CHOKE STRUCTURE FORMED IN THE WIRING BOARD

(75) Inventors: Yoshimasa Sugimoto, Kirishima (JP); Takayuki Shirasaki, Kirishima (JP)

(73) Assignee: Kyocera Corporation, Kyoto (JP)

( * ) Notice: Subject to any disclaimer, the term of this patent is extended or adjusted under 35 U.S.C. 154(b) by 233 days.

(21) Appl. No.: 12/680,729

(22) PCT Filed: Sep. 29, 2008

(86) PCT No.: PCT/JP2008/067688

§ 371 (c)(1),
(2), (4) Date: Mar. 29, 2010

(87) PCT Pub. No.: WO2009/041696

PCT Pub. Date: Apr. 2, 2009

(65) Prior Publication Data

US 2010/0231332 A1 Sep. 16, 2010

(30) Foreign Application Priority Data

Sep. 27, 2007 (JP) ..... 2007-252428

(51) Int. Cl.
*H01P 5/107* (2006.01)

(52) U.S. Cl. ..... 333/26; 333/254

(58) Field of Classification Search ..... 333/26, 333/254

See application file for complete search history.

(56) References Cited

U.S. PATENT DOCUMENTS

| | | | | |
|---|---|---|---|---|
| 3,155,923 | A | 11/1964 | Persson | |
| 2003/0042993 | A1 * | 3/2003 | Sayanagi et al. | 333/26 |
| 2004/0155723 | A1 | 8/2004 | Koriyama | 333/26 |
| 2007/0085626 | A1 * | 4/2007 | Lee et al. | 333/26 |

FOREIGN PATENT DOCUMENTS

| | | | |
|---|---|---|---|
| GB | 902128 | A | 7/1962 |
| JP | 58047301 | A | 3/1983 |
| JP | 04040101 | A | 2/1992 |
| JP | 08-139504 | | 5/1996 |
| JP | 10224101 | A | 8/1998 |
| JP | 2002208807 | A | 7/2002 |
| JP | 2003-188601 | | 7/2003 |
| JP | 2004-153415 | | 5/2004 |
| JP | 2005-278016 | | 10/2005 |

OTHER PUBLICATIONS

Extended European search report dated Jun. 20, 2012 issued in corresponding European application 08833130.1.

* cited by examiner

*Primary Examiner* — Benny Lee
(74) *Attorney, Agent, or Firm* — DLA Piper (US) LLP

(57) ABSTRACT

A high-frequency module has a wiring board including a dielectric substrate, a line conductor that is formed on a first surface of the dielectric substrate, and a first grounding conductor layer that is formed on a second surface opposed to the first surface of the dielectric substrate, and that has a first opening and a second opening disposed around the first opening; and a waveguide that is connected to the second surface, has an opening opposed to the first opening, and is electromagnetically coupled to the line conductor. The wiring board has a vertical choke portion that at least partially extends from the second opening in a direction perpendicular to the second surface. Furthermore, a horizontal choke portion is formed between the wiring board and the waveguide, along the second surface between the opening of the waveguide and the second opening.

8 Claims, 12 Drawing Sheets

HIGH FREQUENCY MODULE COMPRISING A TRANSITION BETWEEN A WIRING BOARD AND A WAVEGUIDE AND INCLUDING A CHOKE STRUCTURE FORMED IN THE WIRING BOARD

CROSS REFERENCE TO RELATED APPLICATION

This application is a national stage of international application No. PCT/JP2008/067688 filed on Sep. 29, 2008, which also claims priority to and the benefit of Japanese Patent Application No. 2007-252428 filed Sep. 27, 2007, the entire content of which are incorporated herein by reference.

TECHNICAL FIELD

The present invention relates to a high-frequency module that transmits, for example, a microwave or millimeter-wave high-frequency signal; and a wiring board for use in the high-frequency module.

Background Art

Conventionally, a high-frequency module is known in which a wiring board having a line conductor and a waveguide are arranged. Typically, this sort of high-frequency module is provided with a waveguide converter that converts a transmission mode between the line conductor of the wiring board and the waveguide. The waveguide converter is formed in, for example, a plate-shaped wiring board having a line conductor, an antenna pattern, and the like. This sort of wiring board is connected to the waveguide via a brazing filler metal or the like (see Patent Document 1, for example).

However, in the case where the brazing filler metal is peeled away or the like to form a gap in a portion connecting the wiring board and the waveguide, radio waves leak from the gap, which may cause a transmission loss. It is conceivable to apply methods for reducing the gap as much as possible by screwing the wiring board and the waveguide or by providing an additional member such as a gasket between the wiring board and the waveguide, but these methods are problematic, for example, in that the size of the high-frequency module increases and the number of manufacturing steps increases. Thus, there is a demand for a high-frequency module that is as small as possible and that can be easily produced.

Patent Document 1: Japanese Unexamined Patent Publication JP-A 8-139504 (1996)

SUMMARY OF THE INVENTION

According to an aspect of the invention, a high-frequency module comprises a wiring board; and a waveguide that is connected to the wiring board. The wiring board includes a dielectric substrate, a line conductor that is formed on a first surface of the dielectric substrate, and a first grounding conductor layer that is formed on a second surface opposed to the first surface of the dielectric substrate, and that has a first opening and a second opening disposed around the first opening. The waveguide is connected to the second surface, and has an opening opposed to the first opening. The waveguide is electromagnetically coupled to the line conductor. The wiring board has a vertical choke portion that at least partially extends from the second opening in a direction perpendicular to the second surface. A horizontal choke portion is formed between the wiring board and the waveguide, along the second surface between the opening of the waveguide and the second opening.

According to an aspect of the invention, a wiring board comprises a dielectric substrate, a line conductor that is formed on a first surface of the dielectric substrate, a first grounding conductor layer that is formed on a second surface opposed to the first surface of the dielectric substrate, and a vertical choke portion that is formed in the dielectric substrate. The first grounding conductor layer has a first opening and a second opening disposed around the first opening. The vertical choke portion extends from the second opening in a direction perpendicular to the second surface.

With the high-frequency module according to the aspect of the invention, a high-frequency module that is small and that can be easily produced can be realized.

With the wiring board according to the aspect of the invention, a high-frequency module that is small and that can be easily produced can be realized using that wiring board.

BEST MODE FOR CARRYING OUT THE INVENTION

Figure 1:
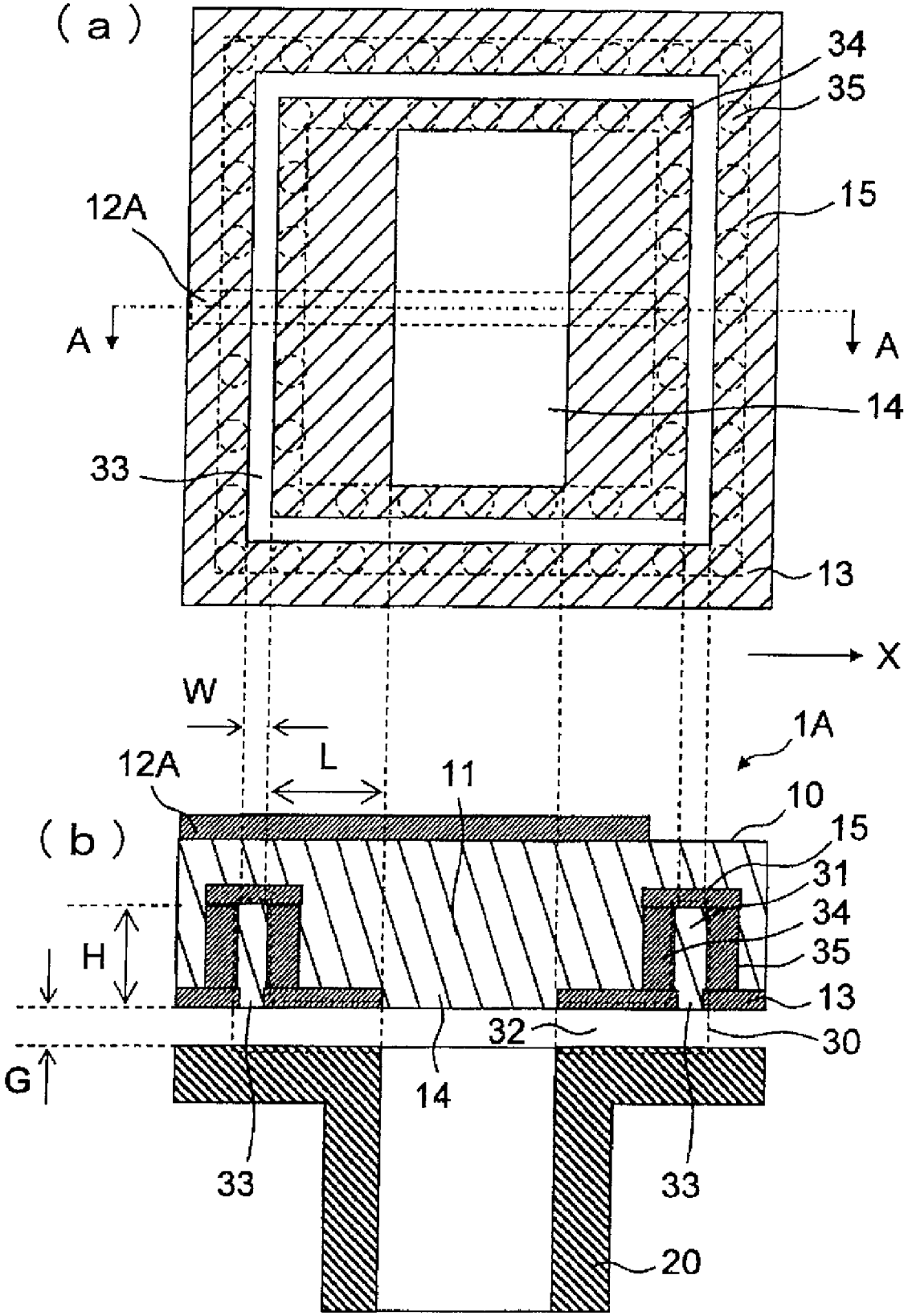
FIG. 1(*a*) is a see-through view of a high-frequency module according to Embodiment 1 of the invention from a lower face thereof, and FIG. 1(*b*) is a cross-sectional view of FIG. 1(*a*) taken along line A-A.
Figure 2:
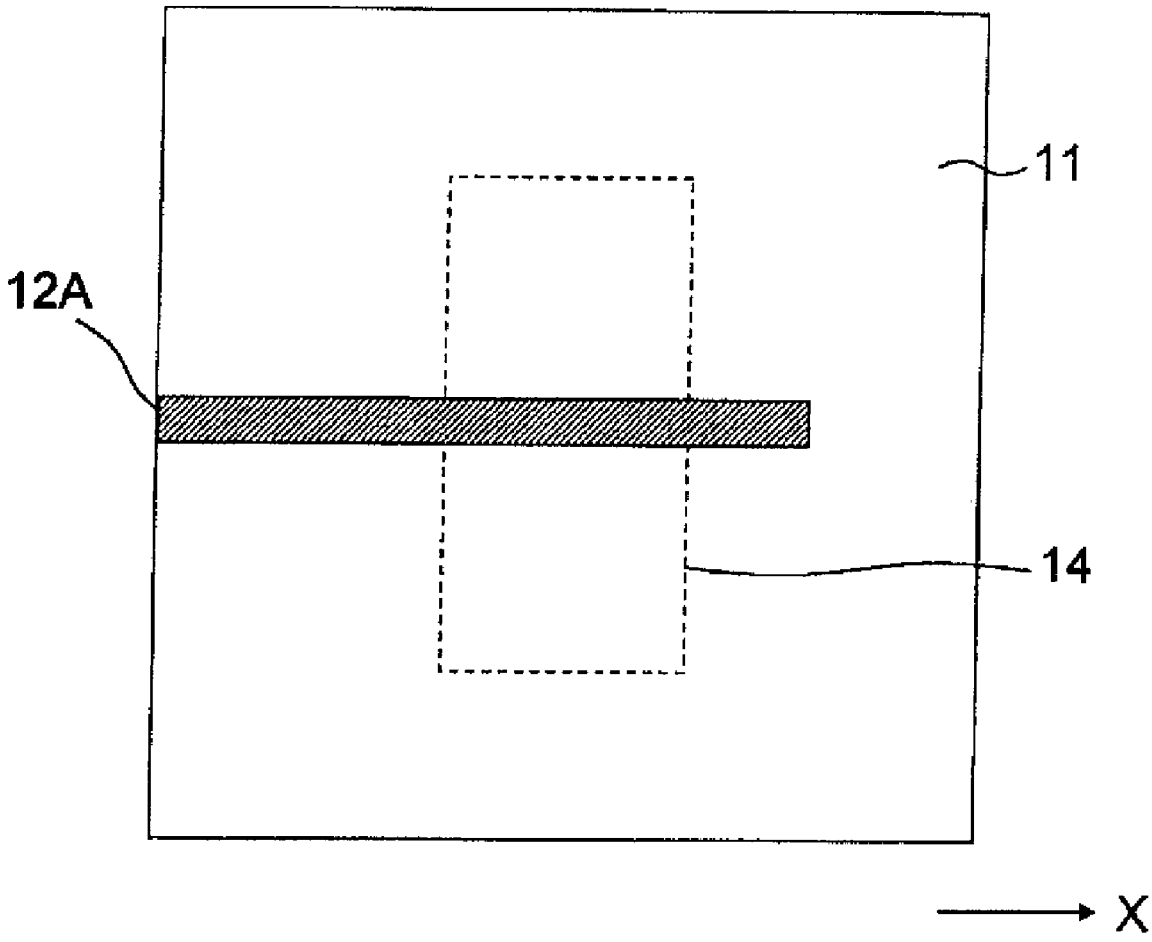
FIG. 2 is a see-through view of the high-frequency module of FIG. 1(*a*) from an upper face thereof.

Now referring to the accompanying drawings, embodiments of the invention are described in detail below, where like features in the accompanying drawing are denoted by the same reference numeral.

(Embodiment 1)

As collectively shown in FIGS. 1(*a*), 1(*b*) and 2 (reference numerals being associated with the relevant view), a high-frequency module 1A according to this embodiment has a wiring board 10 and a waveguide 20 that is connected to the wiring board 10. The wiring board 10 includes a dielectric substrate 11 a line conductor 12A that is formed on the upper face of the dielectric substrate 11, and a first grounding conductor layer 13 that is formed on the lower face of the dielectric substrate 11. The first grounding conductor layer 13 has a first opening 14. The line conductor 12A is formed so as to be electromagnetically coupled to the first opening 14. The line conductor 12A, together with the first grounding conductor layer 13, constitutes a microstrip line.

Here, the first opening 14 is in the shape of a quadrilateral slit having longer sides perpendicular to the line conductor 12A. The shape and size of the slit are determined such that a signal is efficiently transmitted via the first opening 14 between the waveguide 20 and the line conductor 12A.

The waveguide 20 is connected to the lower face of the wiring board 10 such that an opening thereof is opposed to the first opening 14 of the first grounding conductor layer 13. The wiring board 10 has an internal grounding conductor layer 15 in the shape of a ring having an opening inside the dielectric substrate 11. Here, the edge of the opening of the waveguide 20 substantially matches the edge of the first opening 14 of the first grounding conductor layer 13.

Furthermore, the high-frequency module 1A has a choke structure 30. The choke structure 30 has a vertical choke portion 31 and a horizontal choke portion 32. Here, the first grounding conductor layer 13 has a second opening 33 around the first opening 14. The vertical choke portion 31 is formed in the wiring board 10, and extends from the second opening 33 in a direction perpendicular to the lower face of the dielectric substrate 11. The vertical choke portion 31 is formed so as to be surrounded by a plurality of first via-conductors 34, a plurality of second via-conductors 35, and the internal grounding conductor layer 15. Here, the plurality of first via-conductors 34 are arranged along the inner periphery of the second opening 33, and connect the first grounding conductor layer 13 and the internal grounding conductor layer 15. The plurality of second via-conductors 35 are arranged along the outer periphery of the second opening 33, and connect the first grounding conductor layer 13 and the internal grounding conductor layer 15.

The horizontal choke portion 32 is disposed between the wiring board 10 and the waveguide 20 in the case where a gap G is formed between the wiring board 10 and the waveguide 20 along the lower face of the dielectric substrate 11 from the opening of the waveguide 20 to the second opening 33, and is formed along the lower face of the wiring board 10 between the outer peripheral edge of the first opening 14 of the first grounding conductor layer 13 and the inner peripheral edge of the second opening 33. As indicated by the broken line in FIG. 1(*b*), the choke structure 30 has an L-shaped cross-section. In FIG. 1(*b*), the gap G is uniformly formed between the wiring board 10 and the waveguide 20 from the opening of the waveguide 20 to the end portion the wiring board 10.

In this sort of the high-frequency module 1A, a distance L between the outer peripheral edge of the first opening 14 of the first grounding conductor layer 13 and the inner peripheral edge of the second opening 33 in an extension direction X of the line conductor 12A is substantially ¼ the effective wavelength of a high-frequency signal transmitted through the line conductor 12A. Furthermore, a distance H between the first grounding conductor layer 13 and the internal grounding conductor layer 15 is substantially ¼ the effective wavelength of a high-frequency signal transmitted through the line conductor 12A. Here, "effective wavelength" is a wavelength obtained in consideration of a dielectric constant of space through which a high-frequency signal is transmitted. For example, in the case where a high-frequency signal is transmitted through the dielectric substrate 11, the wavelength is shorter than in a vacuum due to the influence of the dielectric constant of the dielectric substrate 11.

When the distances L and H are set in this manner, the electric field strength near the edge of the opening of the waveguide 20 and at the upper end of the vertical choke portion 31 is 0. Furthermore, a point at which the electric field strength is highest is present on the boundary between the vertical choke portion 31 and the horizontal choke portion 32. Accordingly, a resonance occurs in which the gap near the edge of the opening of the waveguide 20 is electromagnetically blocked, and leakage of a high-frequency signal can be suppressed.

Furthermore, in the case where the distance L is set as described above and a width W of the second opening 33 is substantially ¼ to substantially ½ the effective wavelength of a high-frequency signal transmitted, the gap between the first via-conductors 34 and the second via-conductors 35 is wide, and, thus, the electric field generated in the vertical choke portion 31 is smaller than the electric field generated in the horizontal choke portion 32. The reason for this is that, based on the relationship (Electric field)=(Voltage)/(Distance), the electric field is reduced as the distance increases. Accordingly, even at a frequency where ¼ of the effective wavelength does not match the length of the horizontal choke portion 32 and the length of the vertical choke portion 31, the electric field strength near the edge of the opening of the waveguide 20 and at the upper end of the vertical choke portion 31 is 0, and a point at which the electric field strength is highest is present on the boundary between the vertical choke portion 31 and the horizontal choke portion 32. As a result, a resonance occurs in which the gap near the edge of the opening of the waveguide 20 is electromagnetically blocked, and leakage of a high-frequency signal can be suppressed.

Furthermore, in the case where the width W of the second opening 33 is set to be more than 0 and not greater than ½ the effective wavelength of a high-frequency signal transmitted, leakage of a high-frequency signal can be effectively suppressed. That is to say, in the case where the gap between the first via-conductors 33 and the second via-conductors 34 is set to be smaller than ½ the effective wavelength of a high-frequency signal, a vertical electric field in the vertical choke portion 31 can be suppressed, and, as a result, leakage of a high-frequency signal can be suppressed.

With the high-frequency module 1A according to this embodiment, the vertical choke portion 31 is disposed in the dielectric substrate 11, and, thus, the size of the choke structure 30 can be reduced by a wavelength shortening effect. Furthermore, the vertical choke portion 31 can be formed in the dielectric substrate 11 during production of the dielectric substrate 11, and, thus, an increase in the number of manufacturing steps due to addition of the choke structure 30 can be reduced.

In the high-frequency module 1A shown collectively in FIGS. 1(*a*), 1(*b*) and 2 (reference numerals being associated with the relevant view), a high-frequency line formed in the wiring board 10 is realized as a microstrip line, but also can be realized as another configuration.

Figure 3:
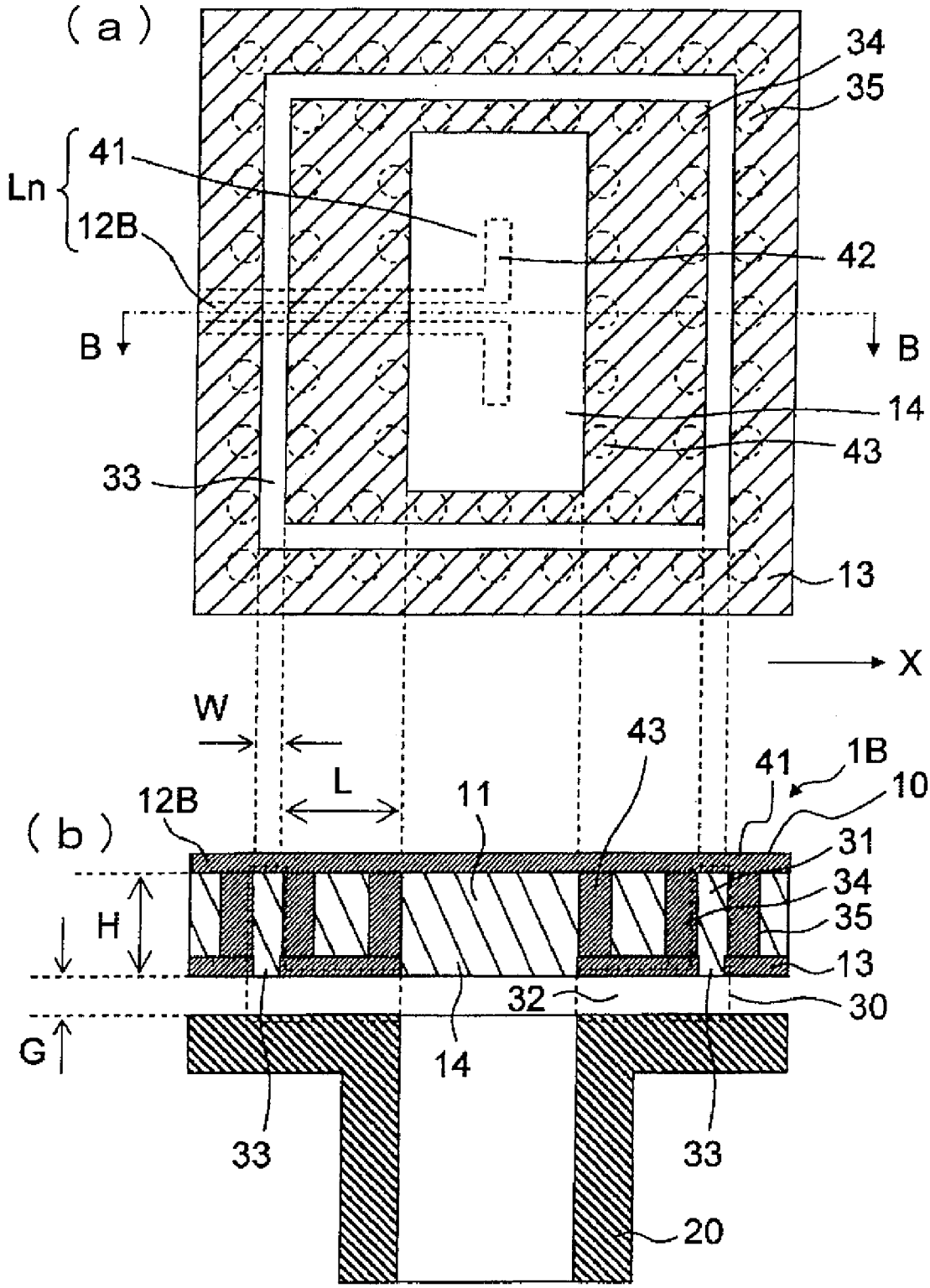
FIG. 3(*a*) is a see-through view of another high-frequency module according to Embodiment 1 of the invention from a lower face thereof, and FIG. 3(*b*) is a cross-sectional view of FIG. 3(*a*) taken along line B-B.
Figure 4:
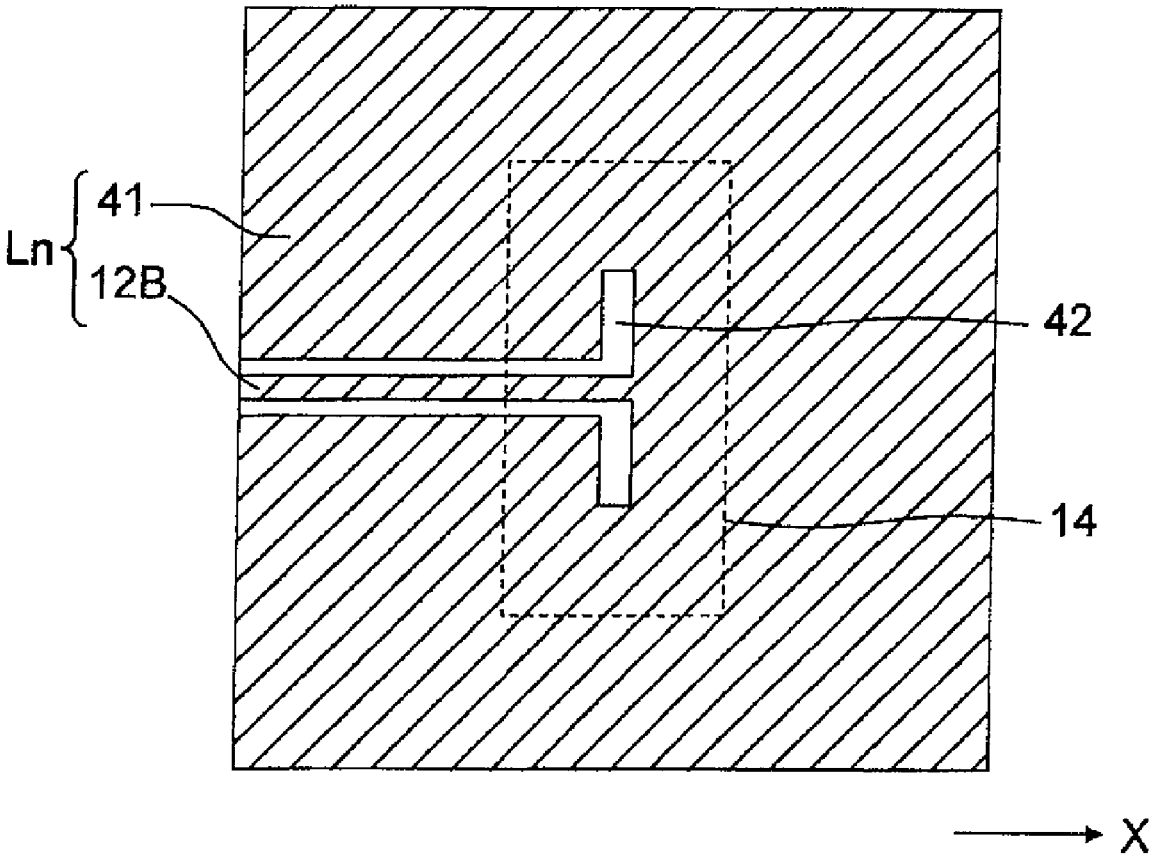
FIG. 4 is a see-through view of the high-frequency module of FIG. 3(*a*) from an upper face thereof.

In a high-frequency module 1B shown collectively in FIGS. 3(*a*), 3(*b*) and 4 (reference numerals being associated with the relevant view), a high-frequency line Ln has a line conductor 12B that is formed on the upper face of the dielectric substrate 11 and a same plane grounding conductor layer 41 that is formed so as to surround one end portion of the line conductor 12B on the upper face of the dielectric substrate 11. On the same plane grounding conductor layer 41, slots 42 electromagnetically coupled to the line conductor 12B are formed so as to be perpendicular to one end portion of the line conductor 12B. Furthermore, the wiring board 10 has shield conductor portions (hereinafter, also referred to as "first shield conductor portions") 43 that surround the first opening 14 of the first grounding conductor layer 13 and that connect the same plane grounding conductor layer 41 and the first grounding conductor layer 13.

The vertical choke portion 31 is formed so as to be surrounded by the first via-conductors 34, the second via-conductors 35, and the same plane grounding conductor layer 41. The first via-conductors 34 are arranged along the inner periphery of the second opening 33, and connect the first grounding conductor layer 13 and the same plane grounding conductor layer 41. The second via-conductors 35 are arranged along the outer periphery of the second opening 33, and connect the first grounding conductor layer 13 and the same plane grounding conductor layer 41.

Furthermore, the distance L between the outer peripheral edge of the first opening 14 of the first grounding conductor layer 13 and the inner peripheral edge of the second opening 33 in an extension direction X of the line conductor 12B is substantially ¼ the effective wavelength of a high-frequency signal transmitted through the line conductor 12B. Furthermore, the distance H between the first grounding conductor layer 13 and the same plane grounding conductor layer 41 is substantially ¼ the effective wavelength of a high-frequency signal transmitted through the line conductor 12B.

Here, in FIGS. 3(*a*), 3(*b*) and 4, the same configurations as in FIGS. 1(*a*), 1(*b*) and 2 are denoted by the same reference numerals. Furthermore, configurations that are not particularly described are similar to those in FIGS. 1(*a*), 1(*b*) and 2.

In the high-frequency module 1B, the line conductor 12B, together with the same plane grounding conductor layer 41 and the first grounding conductor layer 13, constitutes a grounded coplanar line. The slots 42 have longer sides in a direction perpendicular to the line conductor 12B. The length of the longer sides is, for example, substantially ½ the effective wavelength of a high-frequency signal transmitted. Furthermore, the length of the shorter sides is determined so as to obtain an optimal impedance that forms electromagnetic coupling via the first opening 14. In the description above, an example is shown in which the front end of the line conductor 12B is short-circuited by the same plane grounding conductor layer 41, but the front end of the line conductor 12B also may be formed as an open end.

The high-frequency module 1B shown in FIGS. 3(*a*), 3(*b*) and 4 can obtain an effect as in the high-frequency module 1A shown in FIGS. 1(*a*), 1(*b*) and 2.

In both of the two high-frequency modules 1A and 1B, parts for generating or controlling high-frequency waves, such as an RF-IC, a transmitter, an amplifier, or the like, can be mounted on the dielectric substrate 11.

(Embodiment 2)

Figure 5:
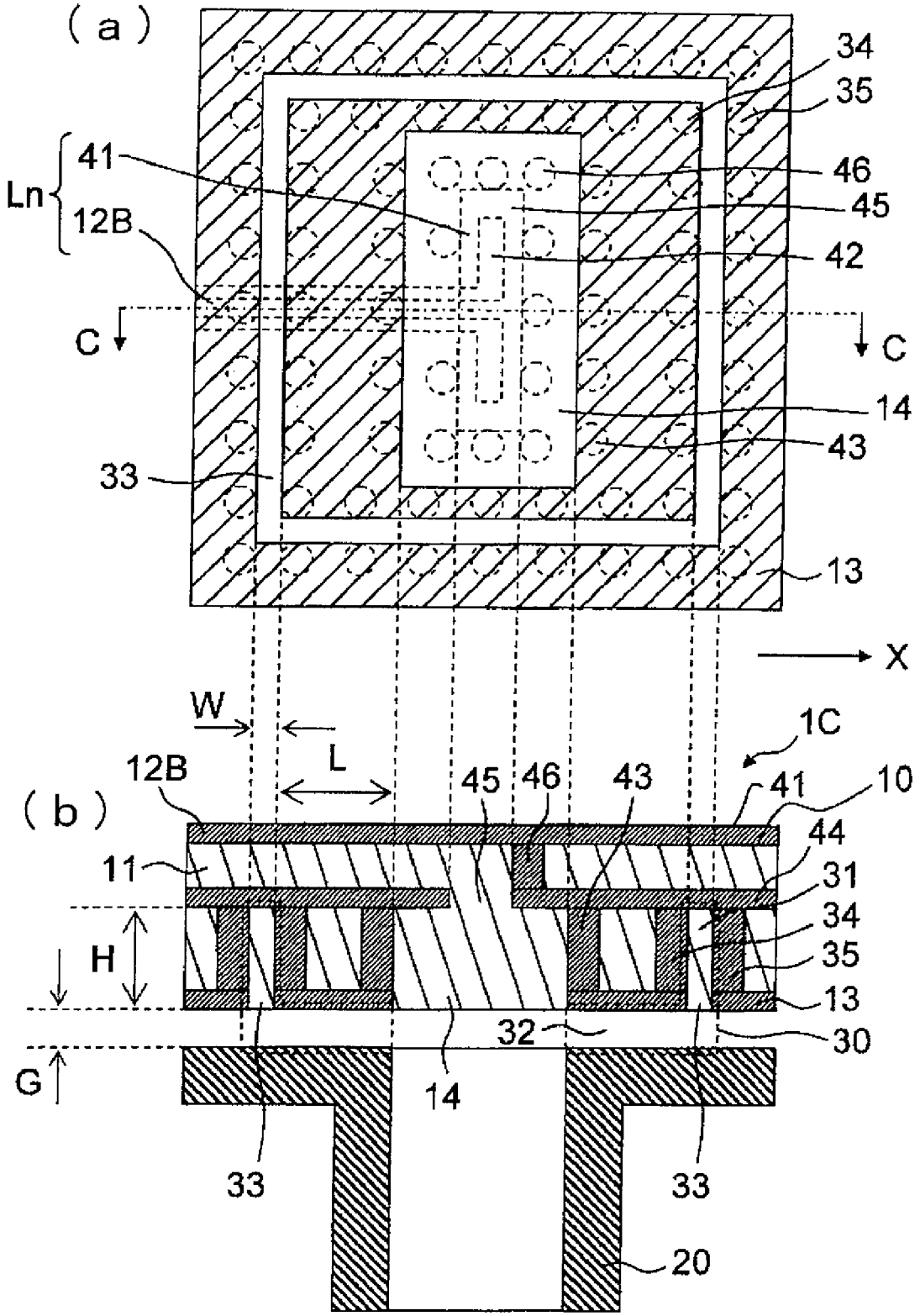
FIG. 5(*a*) is a see-through view of a high-frequency module according to Embodiment 2 of the invention from a lower face thereof, and FIG. 5(*b*) is a cross-sectional view of FIG. 5(*a*) taken along line C-C.
Figure 6:
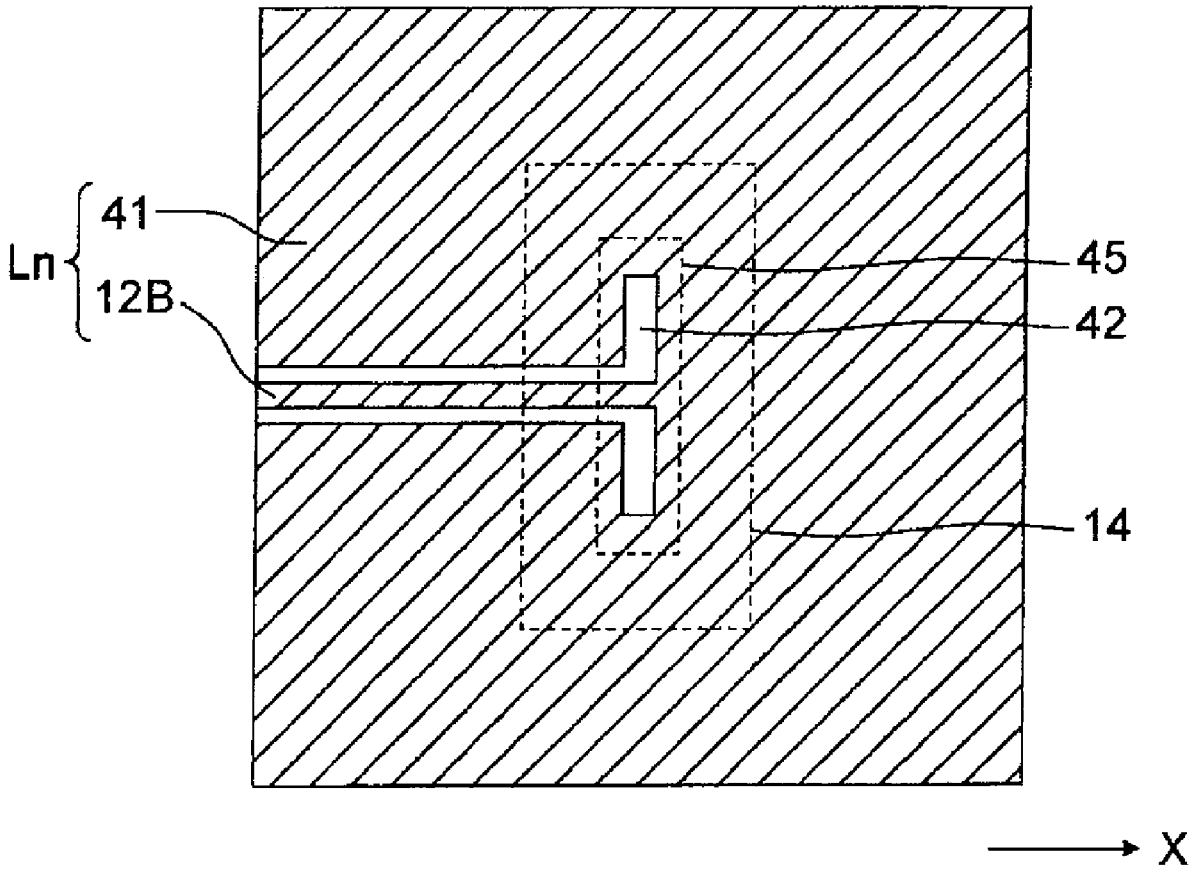
FIG. 6 is a see-through view of the high-frequency module of FIG. 5(*a*) from an upper face thereof.

As shown collectively in FIGS. 5(*a*), 5(*b*) and 6 (reference numerals being associated with the relevant view), a high-frequency module 1C according to this embodiment has an internal grounding conductor layer 44 inside the dielectric substrate 11. The internal grounding conductor layer 44 is a frame-shaped grounding conductor layer that has an opening 45 opposed to the first opening 14. The opening 45 functions as a transmission opening. The opening 45 is formed in the internal grounding conductor layer 44 so as to surround the slots 42 and to be positioned inside the first opening 14 when seen through from above. Furthermore, shield conductor portions (hereinafter, also referred to as "second shield conductor portions") 46 that connect the same plane grounding conductor layer 41 and the internal grounding conductor layer 44 are formed along the outer periphery of the opening 45. The shield conductor portions 46 are formed so as to surround the opening 45 when seen through from above.

Here, in FIGS. 5(*a*), 5(*b*) and 6, the same configurations as in FIGS. 1(*a*), 1(*b*), 2, 3(*a*), 3(*b*) and 4 are denoted by the same reference numerals. Furthermore, configurations that are not particularly described are similar to those in FIGS. 1(*a*), 1(*b*), 2, 3(*a*), 3(*b*) and 4.

In the high-frequency module 1C according to Embodiment 2, reflected waves are present that are emitted from the slots 42, that are reflected at the boundary between the dielectric substrate 11 and the waveguide 20, that are again reflected by the internal grounding conductor layer 44, and that return to the boundary between the dielectric substrate 11 and the waveguide 20. Here, in the case where the distance H between the internal grounding conductor layer 44 and the waveguide 20 is substantially ¼ the effective wavelength of a high-frequency signal transmitted to the high-frequency line Ln, a path difference between the above-described reflected waves and direct waves directly transmitted from the slots 42 to the boundary between the dielectric substrate 11 and the waveguide 20 is substantially ½ the effective wavelength of the high-frequency signal, and the phase of the high-frequency signal is reversed when the reflected waves are reflected by the internal grounding conductor layer 44. Thus, such high-frequency signals intensify each other, and the high-frequency signals transmitted through the wiring board 10 are efficiently transmitted to the waveguide 20.

That is to say, the dielectric substrate 11 that is interposed between the internal grounding conductor layer 44 and the waveguide 20 and that has a thickness set to substantially ¼ the effective wavelength of a high-frequency signal functions as an impedance matching box between the slots 42 and the waveguide 20 having mutually different impedances.

Furthermore, the vertical choke portion 31 is disposed in the dielectric substrate 11, and, thus, the size of the choke structure 30 can be reduced by a wavelength shortening effect. Furthermore, the choke structure 30 can be formed in the dielectric substrate 11 during production of the dielectric substrate 11, and, thus, an increase in the number of manufacturing steps due to addition of the choke structure 30 can be reduced.

Furthermore, the vertical choke portion 31 is disposed in the dielectric substrate 11, and, thus, the size of the choke structure 30 can be reduced by a wavelength shortening effect. Furthermore, the choke structure 30 can be formed in the dielectric substrate 11 during production of the dielectric substrate 11, and, thus, an increase in the number of steps due to addition of the choke structure 30 can be suppressed.

Furthermore, the length H of the vertical choke portion 31 formed in the dielectric substrate 11 is substantially ¼ the effective wavelength of a high-frequency signal, and is the same as the distance H between the internal grounding conductor layer 44 and the waveguide 20. Thus, it is not necessary for the thickness of the dielectric substrate 11 to be increased for addition of the choke structure, and a high-frequency module having a thin choke structure can be realized.

Furthermore, in the high-frequency module 1C according to Embodiment 2, it is preferable that, on a face passing through the center of the first opening 14 and perpendicular to the longitudinal direction of the first opening 14 (a cross-section taken along line C-C), the distance L between the edge of the first opening 14 and the inner peripheral edge of the second opening 33 is substantially ¼ the wavelength of a high-frequency signal transmitted, and that the width W of the second opening 33 is substantially ¼ to substantially ½ the effective wavelength of a high-frequency signal transmitted. In other words, it is preferable that, when seen through from above, the distance L between the edge of the first opening 14 and the inner peripheral edge of the second opening 33 in the line direction of the line conductor 12B (the longitudinal direction of the line conductor 12B in the shape of a straight line) is substantially ¼ the effective wavelength of a high-frequency signal transmitted, and that the width W of the second opening 33 is substantially ¼ to substantially ½ the effective wavelength of a high-frequency signal transmitted.

When the distances L and W are set in this manner, the electric field strength near the edge of the opening of the waveguide 20 and at the upper end of the vertical choke portion 31 is 0, and a point at which the electric field strength is highest is present on the boundary between the vertical choke portion 31 and the horizontal choke portion 32. Accordingly, a resonance occurs in which the gap near the edge of the opening of the waveguide 20 is electromagnetically blocked, and leakage of a high-frequency signal can be suppressed.

Furthermore, when the distances L and W are set as described above, the gap between the first via-conductors 34 and the second via-conductors 35 is wide, and, thus, the electric field generated in the vertical choke portion 31 is smaller than the electric field generated in the horizontal choke portion 32, as seen from the relationship (Electric field)=(Voltage)/(Distance) indicating that the electric field is reduced as the distance increases. Accordingly, even at a frequency where substantially ¼ of the effective wavelength of a high-frequency signal does not match the length of the horizontal choke portion 32 and the length of the vertical choke portion 31, the electric field strength near the edge of the opening of the waveguide 20 and at the upper end of the vertical choke portion 31 is 0, and a point at which the electric field strength is highest is present on the boundary between the vertical choke portion 31 and the horizontal choke portion 32. As a result, a resonance occurs in which the gap near the edge of the opening of the waveguide 20 is electromagnetically blocked, and leakage of a high-frequency signal can be suppressed.

Here, in the case where the width W of the second opening 33 is set to be more than 0 and not greater than ½ the effective wavelength of a high-frequency signal transmitted, leakage of a high-frequency signal can be effectively suppressed. That is to say, in the case where the gap between the first via-conductors 34 and the second via-conductors 35 is set to be smaller than ½ the effective wavelength of a high-frequency signal, a vertical electric field in the vertical choke portion 31 can be suppressed, and, as a result, leakage of a high-frequency signal can be suppressed.

Figure 7:
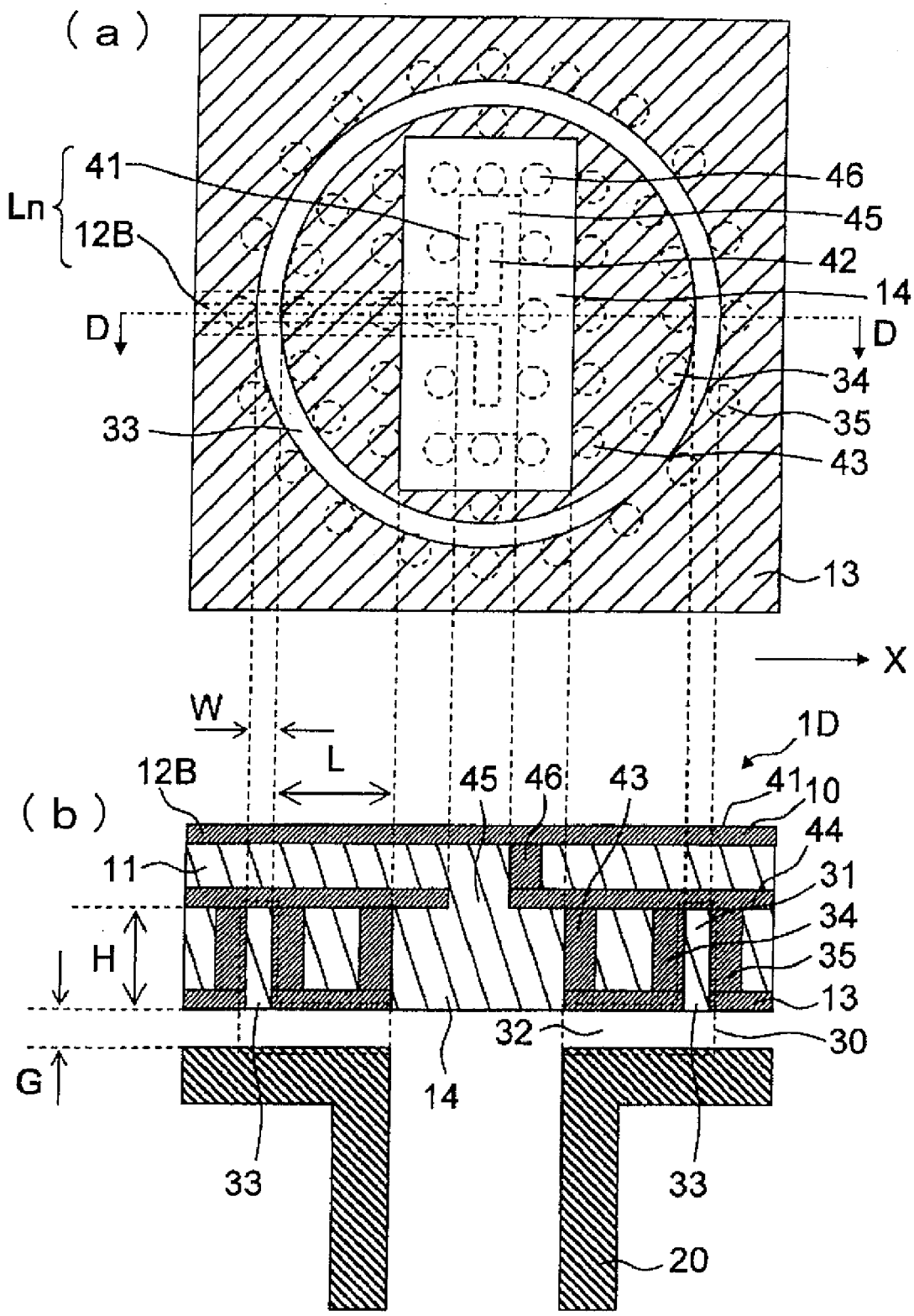
FIG. 7(*a*) is a see-through view of another high-frequency module according to Embodiment 2 of the invention from a lower face thereof, and FIG. 7(*b*) is a cross-sectional view of FIG. 7(*a*) taken along line D-D.

Here, as shown collectively in FIGS. 7(*a*) and 7(*b*) (reference numerals being associated with the relevant view), the second opening 33 may be in the shape of a circular ring. In this case, the effect is similar to that in the case where the second opening 33 is in the shape of a rectangular ring as shown in FIGS. 5(*a*) and 5(*b*). Furthermore, the shape of the wiring board 10 when viewed from above also can be circular in accordance with the second opening 33, and the size of the wiring board 10 can be reduced.

Next, the characteristics of the high-frequency module 1C according to Embodiment 2 will be described. Whether or not the function of a high-frequency module can be obtained can be investigated based on transmission characteristics S21 between the high-frequency line Ln and the waveguide 20. This value is required to be as high as possible in order to transmit a high-frequency signal from the high-frequency line Ln to the waveguide 20 at a high conversion efficiency. Here, A of FIG. 8(*a*) is a graph showing frequency characteristics S21 of a high-frequency module collectively shown in FIGS. 5(*a*), 5(*b*) and 6 (reference numerals being associated with the relevant view) from which the choke structure 30 has been removed in the case where there is no gap between the wiring board 10 and the waveguide 20. Furthermore, B of FIG. 8(*a*) is a graph showing frequency characteristics S21 of a high-frequency module collectively shown in FIGS. 5(*a*), 5(*b*) and 6 (reference numerals being associated with the relevant view) from which the choke structure 30 has been removed in the case where there is a gap G having a size of 0.3 mm between the wiring board 10 and the waveguide 20.

Figure 8:
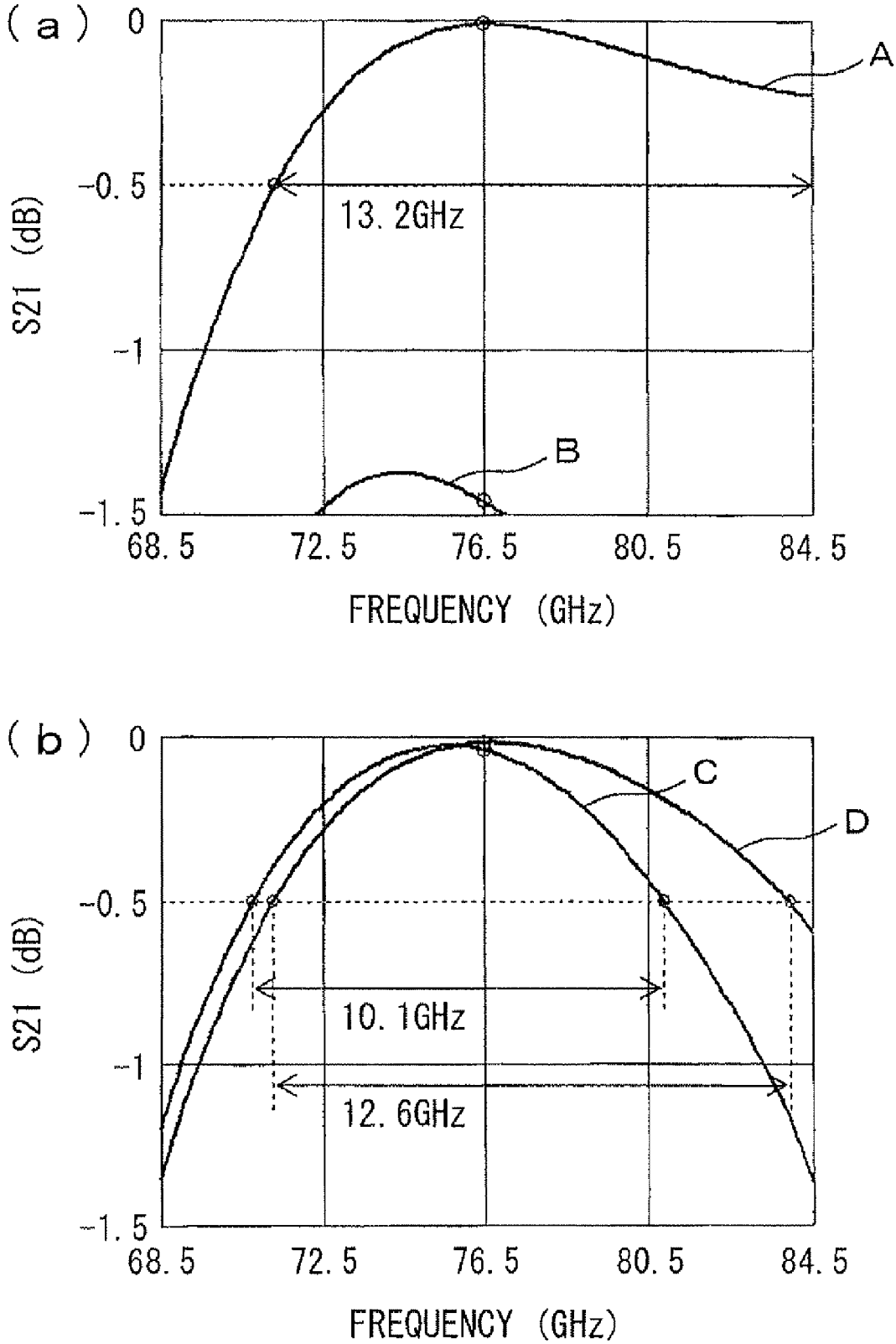
FIG. 8 PRIOR ART
FIG. 8(*a*) is a graph showing frequency characteristics S21 of conventional high-frequency modules having no choke structure, and FIG. 8(*b*) is a graph showing frequency characteristics S21 of the high-frequency modules shown in FIGS. 7(*a*) and 7(*b*)

As shown in FIG. 8(*a*), in the case where there is no gap between the wiring board 10 and the waveguide 20, S21 of the high-frequency module having no choke structure 30 is −0.5 dB or more over a frequency range of 13.2 GHz or more. However, in the case where the gap G is 0.3 mm, a high-frequency signal leaks from the gap, S21 deteriorates and does not become −0.5 dB or more.

Next, C of FIG. 8(*b*) is a graph showing frequency characteristics S21 of the high-frequency module 1C collectively shown in FIGS. 5(*a*), 5(*b*) and 6 (reference numerals being associated with the relevant view) in the case where there is a gap G having a size of 0.3 mm between the dielectric substrate 11 and the waveguide 20, the distance L is 1 mm, which is ¼ the effective wavelength of a high-frequency signal transmitted, and the width W of the second opening 33 is 0.34 mm, which is ¼ the effective wavelength of a high-frequency signal transmitted. Furthermore, D of FIG. 8(*b*) is a graph showing frequency characteristics S21 of the high-frequency module 1C shown in FIGS. 5(*a*), 5(*b*) and 6 in the case where there is a gap G having a size of 0.3 mm between the dielectric substrate 11 and the waveguide 20, the distance L is 1 mm, which is ¼ the effective wavelength of a high-frequency signal transmitted, and the width W of the second opening 33 is 0.68 mm, which is ½ the effective wavelength of a high-frequency signal transmitted.

As indicated by C of FIG. 8(*b*), in the case where the width W of the second opening 33 of the high-frequency module 1C shown collectively in FIGS. 5(*a*), 5(*b*) (reference numerals being associated with the relevant view) and 6 is 0.34 mm, which is ¼ the effective wavelength of a high-frequency signal transmitted, S21 is □0.5 dB or more over a frequency range of 10.1 GHz, and it is seen that S21 is improved compared with that of B of FIG. 8(*a*) in which there is no choke structure.

However, since the dielectric constant of the dielectric substrate 11 of the vertical choke portion 31 is different from the dielectric constant of air present in a gap formed between the dielectric substrate 11 and the waveguide 20, a high-frequency signal is reflected at the boundary between the dielectric substrate 11 of the choke structure 30 and the air, the effect of suppressing leakage of a high-frequency signal is reduced, and the frequency band of a high-frequency signal in which leakage of a high-frequency signal can be suppressed is narrowed by 3.1 GHz or more.

On the other hand, as indicated by D of FIG. 8(*b*), in the case where the width W of the second opening 33 of the high-frequency module 1C shown collectively in FIGS. 5(*a*), 5(*b*) and 6 (reference numerals being associated with the relevant view) is 0.68 mm, which is ½ the effective wavelength of a high-frequency signal transmitted, S21 is −0.5 dB or more over a frequency range of 12.6 GHz, and this band is wider by 2.5 GHz than in C of FIG. 8(*b*) in which the width W of the second opening 33 is 0.34 mm.

The reason for this is that the gap between the first via-conductors 34 and the second via-conductors 35 is as wide as 0.68 mm, and, thus, the electric field generated in the vertical choke portion 31 is smaller than the electric field generated in the horizontal choke portion 32, as seen from the relationship (Electric field)=(Voltage)/(Distance) indicating that the electric field is reduced as the distance W increases. Accordingly, even at a frequency where ¼ of the effective wavelength of a high-frequency signal does not match the length L of the horizontal choke portion 32 and the length H of the vertical choke portion 31, the electric field strength near the edge of the opening of the waveguide 20 and at the upper end of the vertical choke portion 31 is 0, a point at which the electric field strength is highest is present on the boundary between the vertical choke portion 31 and the horizontal choke portion 32, and, as a result, a resonance occurs in which the gap near the edge of the opening of the waveguide 20 is electromagnetically blocked, and leakage of a high-frequency signal can be suppressed. As a result, the frequency band of a high-frequency signal in which leakage of a high-frequency signal can be suppressed can be made wider.

Here, in the case where the width W of the second opening 33 is set to be more than 0 and not greater than ½ the effective wavelength of a high-frequency signal transmitted, leakage of a high-frequency signal can be effectively suppressed. That is to say, in the case where the gap between the first via-conductors 34 and the second via-conductors 35 is set to be smaller than ½ the effective wavelength of a high-frequency signal, a vertical electric field in the vertical choke portion 31 can be suppressed, and, as a result, leakage of a high-frequency signal can be suppressed.

As described above, the high-frequency module according to Embodiment 2 can realize broadband characteristics in which S21 is −0.5 dB or more over a frequency range of 12.6 GHz. Accordingly, the high-frequency module according to Embodiment 2 of the invention has excellent characteristics around a frequency band used for a vehicle-mounted collision-preventing radar (76 GHz band), and, thus, can be sufficiently applied as a high-frequency module for a vehicle-mounted collision-preventing radar.

(Embodiment 3)

Figure 9:
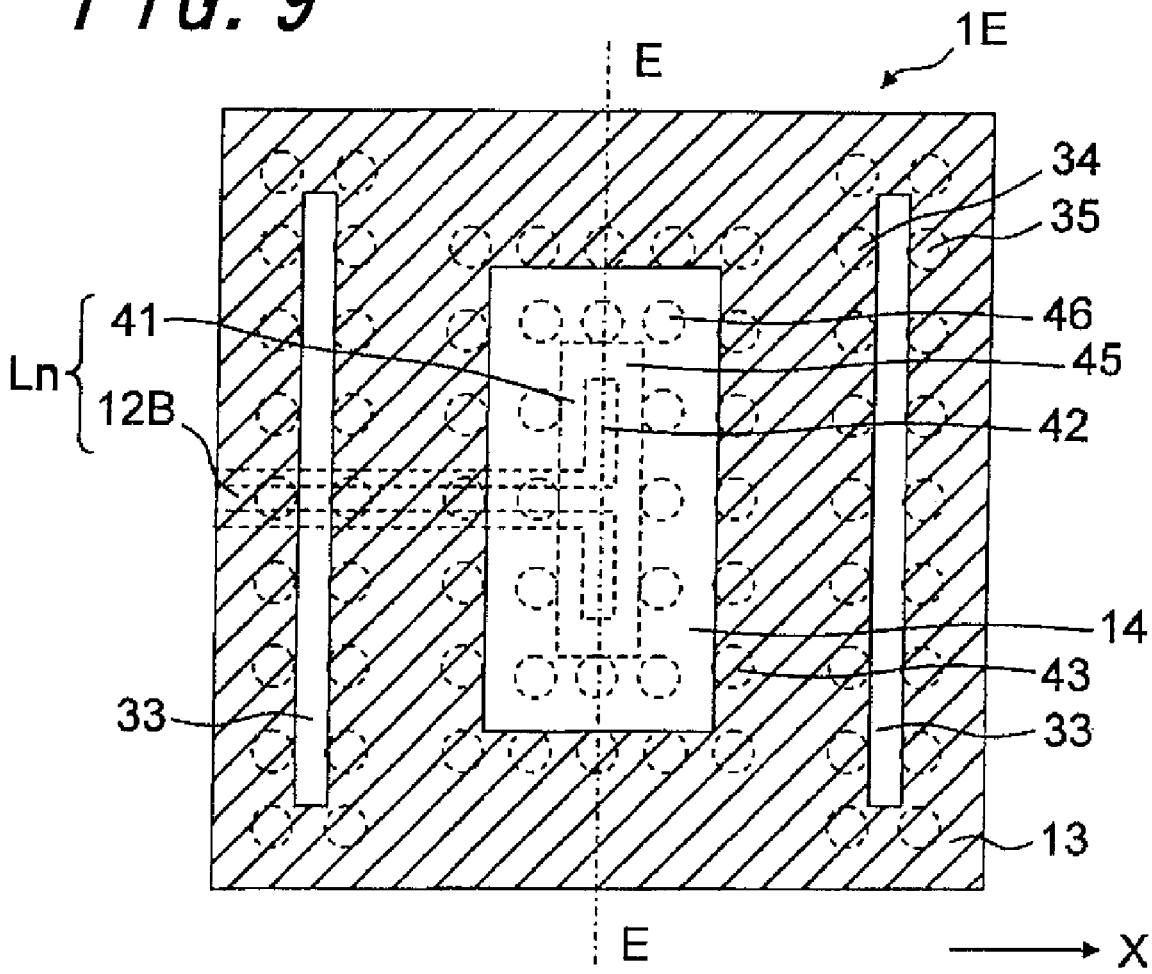
FIG. 9 is see-through view of a high-frequency module according to Embodiment 3 of the invention from a lower face thereof.

As shown in FIG. 9, a high-frequency module 1E according to Embodiment 3 has a pair of second openings 33 that are arranged as mirror images about a face passing through the center of the first opening 14 and perpendicular to the transverse direction of the first opening 14 (E-E face). In other words, the second openings 33 are a pair of openings that are axisymmetric about a line passing through the center of the first opening 14 and perpendicular to the line direction of the line conductor 12B when seen through from above.

According to the high-frequency module 1E according to Embodiment 3, even in the case where an unwanted resonance occurs at a frequency corresponding to the length of the second openings 33 when the high-frequency module 1E is viewed from above, the length of the second openings 33 can be easily adjusted, and, thus, the frequency of such an unwanted resonance occurring at the vertical choke portion 33 can be more easily set to a frequency that does not affect transmission of a high-frequency signal.

(Embodiment 4)

Figure 10:
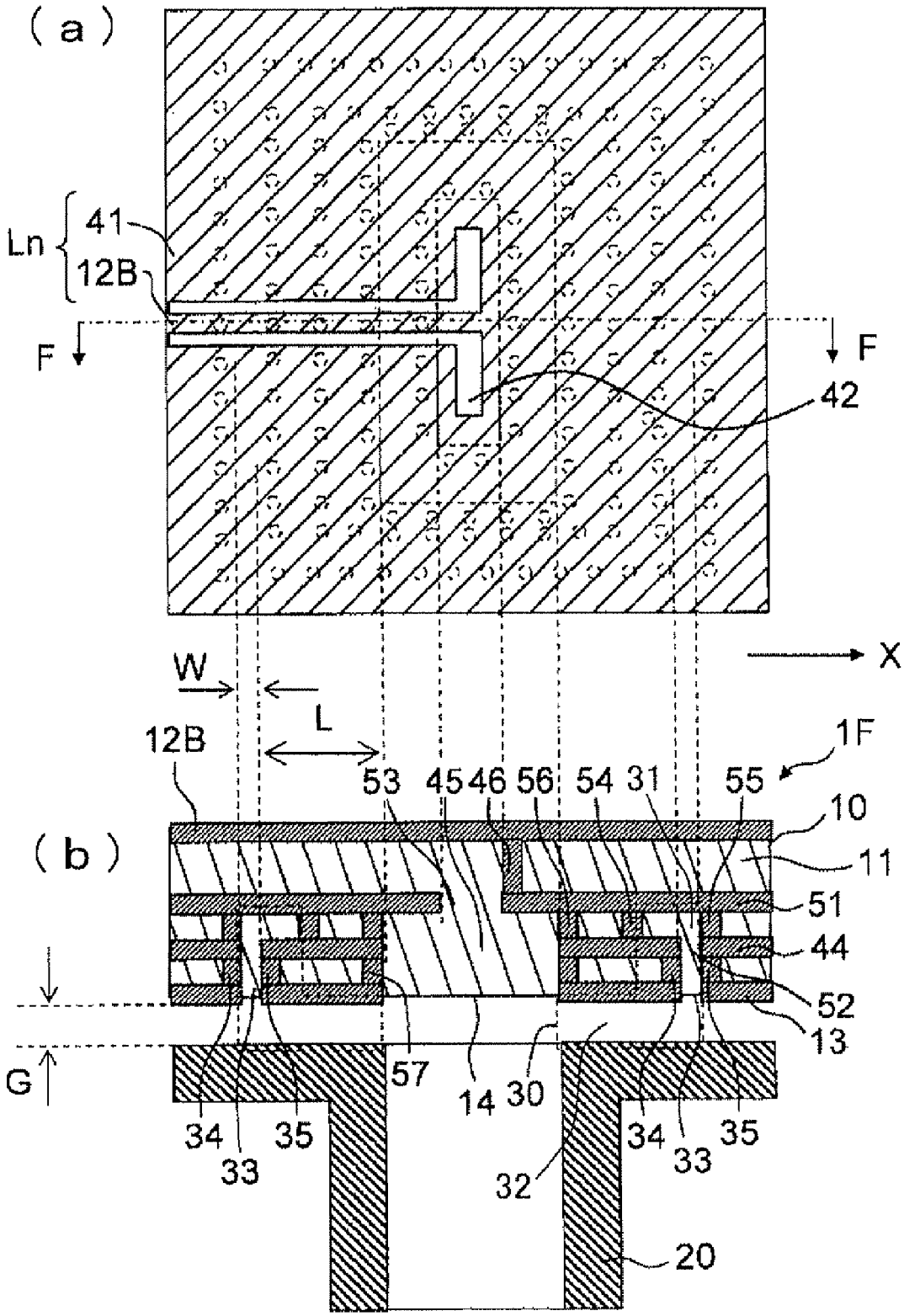
FIG. 10(*a*) is a see-through view of a high-frequency module according to Embodiment 4 of the invention from a lower face thereof, and FIG. 10(*b*) is a cross-sectional view of FIG. 10(*a*) taken along line F-F.

A high-frequency module 1F shown collectively in FIGS. 10(*a*) and 10(*b*) (reference numerals being associated with the relevant view) has a configuration similar to that of the high-frequency module 10 shown collectively in FIGS. 5(*a*), 5(*b*) and 6, but has a vertical choke portion 31 including a first waveguide portion 31A that extends in the thickness direction of the dielectric substrate 11 and a second waveguide portion 31B that is parallel to the horizontal choke portion 32 and has a short-circuited terminal end. Here, the horizontal choke portion 32, the first waveguide portion 31A, and the second waveguide portion 31B are connected in series.

The high-frequency module 1F according to this embodiment has internal grounding conductor layers 44 and 51 that are formed inside the dielectric substrate 11. The internal grounding conductor layer 44 has the opening 45 that is opposed to the first opening 14 and an opening 52 that is opposed to the second opening 33. Furthermore, the internal grounding conductor layer 51 is disposed between the internal grounding conductor layer 44 and the same plane grounding conductor layer 41, and has an opening 53 that is opposed to the first opening 14 and the opening 45. Here, the opening 53 disposed in the internal grounding conductor layer 51 functions as a transmission opening.

The wiring board 10 has the plurality of first via-conductors 34 that are arranged along the inner periphery of the second opening 33 and that connect the first grounding conductor layer 13 and the internal grounding conductor layer 44, and the plurality of second via-conductors 35 that are arranged along the outer periphery of the second opening 33 and that connect the first grounding conductor layer 13 and the internal grounding conductor layer 44. Furthermore, the wiring board 10 has a plurality of third via-conductors 54 that are arranged along the inner periphery of the opening 52 and that connect the internal grounding conductor layer 44 and the internal grounding conductor layer 51, and a plurality of fourth via-conductors 55 that are arranged along the outer periphery of the opening 52 and that connect the internal grounding conductor layer 44 and the internal grounding conductor layer 51.

Further provided are a plurality of fifth via-conductors 56 that surround the opening 53 and the opening 45 and that connect the internal grounding conductor layer 44 and the internal grounding conductor layer 51 along the edges of the opening 53 and the opening 45, and a plurality of sixth via-conductors 57 that are formed around the first opening 14 and that connect the first grounding conductor layer 13 and the internal grounding conductor layer 44.

Here, the second via-conductors 35 and the fourth via-conductors 55 are arranged vertically and electrically connected via the internal grounding conductor layer 44. Furthermore, in the direction in which the line conductor 12B extends, the third via-conductors 54 is positioned farther away from the opening 52 than the first via-conductors 34.

The vertical choke portion 31 is formed so as to be surrounded by the first via-conductors 34, the second via-conductors 35, the third via-conductors 54, the fourth via-conductors 55, and the internal grounding conductor layer 51. The vertical choke portion 31 has a cross-section in the shape of an inverted L.

In the high-frequency module 1F shown collectively in FIGS. 10(*a*) and 10(*b*) (reference numerals being associated with the relevant view), an example is shown in which the high-frequency line Ln is a grounded coplanar line configured from the line conductor 12B formed on the surface of the dielectric substrate 11, the internal grounding conductor layer 51, and the same plane grounding conductor layer 41. The slots 42 have longer sides in a direction perpendicular to the line conductor 12B, and the length thereof is, for example, ½ the wavelength of a high-frequency transmitted through the high-frequency line Ln. In the description above, an example is shown in which the front end of the line conductor 12B is short-circuited to the same plane grounding conductor layer 41, but the front end also may be formed as an open end.

Figure 11:
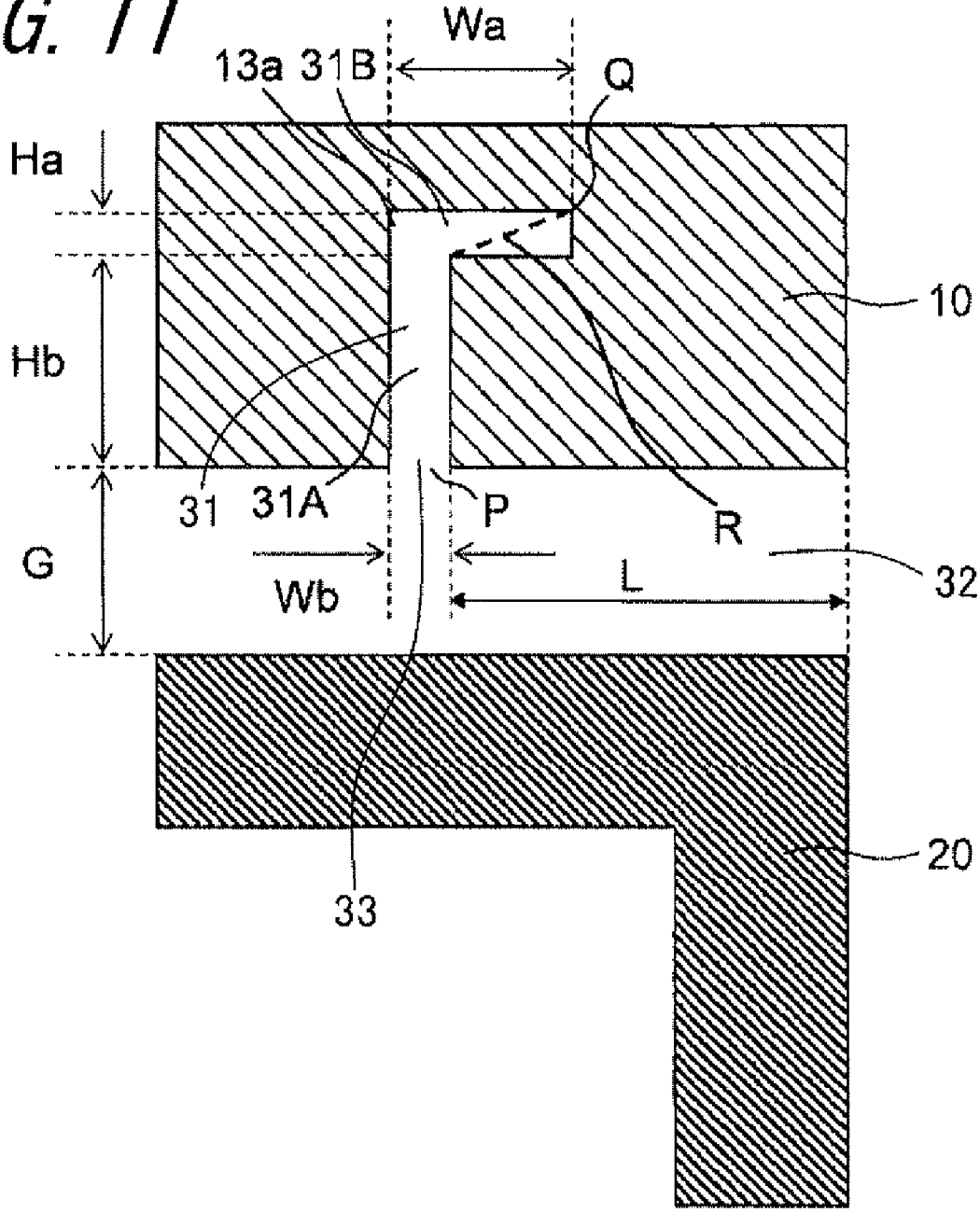
FIG. 11 is an enlarged view of main portions of the high-frequency module of FIGS. 10(*a*) and 10(*b*)

FIG. 11 schematically shows the choke structure 30 of the high-frequency module 1F collectively shown in FIGS. 10(*a*) and 10(*b*) (reference numerals being associated with the relevant view). Here, the case where the distance L of the horizontal choke portion 32 from the wall of the waveguide to a portion P connecting the horizontal choke portion 32 and the vertical choke portion 31 is substantially ¼ the effective wavelength of a high-frequency signal transmitted, the voltage is highest at the portion P connecting the horizontal choke portion 32 and the vertical choke portion 31, the current is highest at the wall of the waveguide, and the choke effect can be obtained in which the wiring board 10 and the waveguide 20 seem to be electrically connected.

Furthermore, in the case where the length of the vertical choke portion, that is, the distance from the portion P connecting the first waveguide portion 31A and the horizontal choke portion 32 to a point Q farthest from the portion P on the wall face of the terminal end of the second waveguide portion 31B is substantially ¼ the effective wavelength λ of a high-frequency signal transmitted, in other words, in the case where the length of a path that extends along the wall face of the first waveguide portion 31A closer to the wall of the waveguide, and then diagonally passes through the second waveguide portion 31B from the point connecting the first waveguide portion 31A and the second waveguide portion 31B, to the point Q on the wall face of the terminal end of the second waveguide portion 31B, which is farthest from the connecting point (the sum of a height Hb of the first waveguide portion 31A and a length of a broken line R diagonally passing through the second waveguide portion 31B) is substantially λ/4, the voltage is highest at the portion P connecting the horizontal choke portion 32 and the vertical choke portion 31, the current is highest at the wall face of the terminal end of the second waveguide portion 31B, and the choke effect can be obtained.

Here, as collectively shown in FIGS. 10(*a*) and 10(*b*) (reference numerals being associated with the relevant view), the first via-conductors 34 and the third via-conductors 54 may be arranged vertically and electrically connected, and the fourth via-conductors 55 may be positioned farther away from the opening 52 than the second via-conductors 35 in the direction in which the line conductor 12B extends. That is to say, in FIG. 11, the second waveguide portion 31B may extend outward (in a direction away from the wall of the waveguide) from the portion connecting the second waveguide portion 31B and the first waveguide portion 31A. A configuration in which the second waveguide portion 31B is formed so as to extend inward (in a direction closer to the wall of the waveguide) from the portion connecting the second waveguide portion 31B and the first waveguide portion 31A as collectively shown in FIGS. 10(*a*), 10(*b*) and 11 (reference numerals being associated with the relevant view) is more advantageous in that the overall size of the high-frequency module can be reduced, but a configuration in which the second waveguide portion 31B is formed so as to extend outward also can obtain an effect as in the high-frequency module collectively shown in FIGS. 10(*a*), 10(*b*) and 11.

In the case where the vertical choke portion 31 includes the first waveguide portion 31A and the second waveguide portion 31B in this manner, the height of the wiring board can be lower than that of the vertical choke portion 31 in the shape of a straight line, and a high-frequency module with a reduced height can be realized.

Furthermore, in the case where the distance L is substantially λ/4, and the width Wb of the second opening 33 is substantially λ/4 to substantially λ/2, and in the case where the width Wb of the second opening 33 is set to be more than 0 and not greater than λ/2, an effect as in Embodiment 1 can be obtained.

Figure 12:
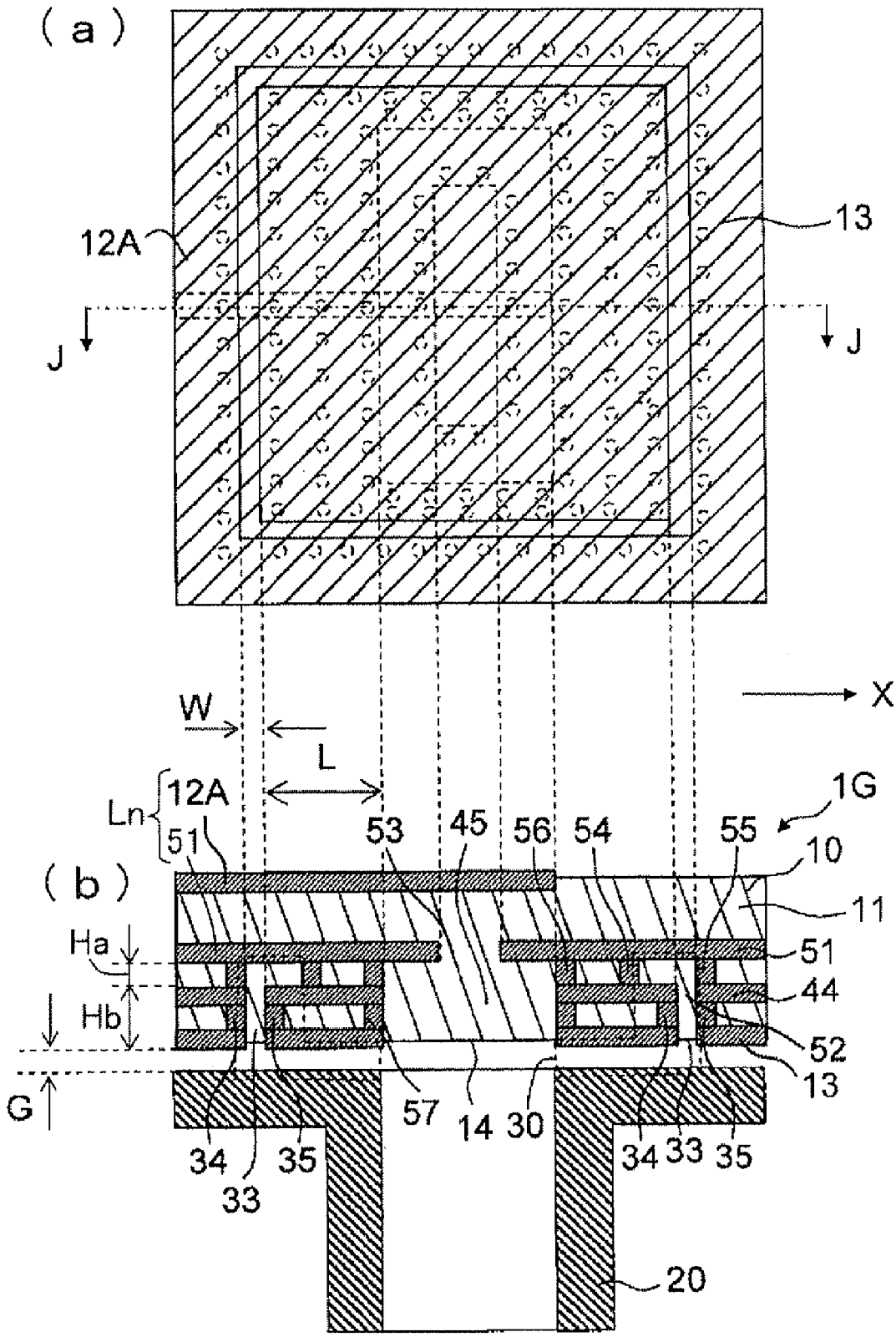
FIG. 12(*a*) is a see-through view of another high-frequency module according to Embodiment 4 of the invention from an upper face thereof, and FIG. 12(*b*) is a cross-sectional view of FIG. 12(*a*) taken along line J-J.

Furthermore, as collectively shown in FIGS. 12(*a*) and 12(*b*) (reference numerals being associated with the relevant view), the line conductor 12A, together with the internal grounding conductor layer 51 disposed inside the dielectric substrate 11, may constitute a microstrip line. The front end of the line conductor 12A is formed as an open end at a predetermined position from the center of the first opening 14 as shown in FIGS. 12(*a*) and 12(*b*), or formed as a short-circuited end that is connected to the internal grounding conductor layer 51.

Here, as collectively shown in FIGS. 10(*a*), 10(*b*), 12(*a*) and 12(*b*) (reference numerals being associated with the relevant view), a dielectric region that is surrounded by the first opening 14, the internal grounding conductor layer 51, the fifth via-conductors 56, and the sixth via-conductors 57 is used as a dielectric resonator, and has the function of realizing a good coupling between the high-frequency line Ln and the waveguide 20. The thickness of the dielectric resonator region is preferably substantially λ/4 a high-frequency signal so as to function as a dielectric resonator. Here, in the case where the thickness is about λ/4, an unwanted mode may occur to cause a problem. In such a case, this phenomenon may be suppressed by reducing the thickness of the dielectric resonator to be smaller than λ/4. In this embodiment, the physical length (not electrical length) (Ha+Hb) of the vertical choke portion is shorter than λ/4, and, thus, the dielectric thickness can be easily reduced.

Examples of a dielectric material for forming the dielectric substrate 11 include a ceramic material mainly containing aluminum oxide, aluminum nitride, silicon nitride, mullite, or the like, a glass, a glass ceramic material formed by firing a mixture of glass and ceramic fillers, an organic resin-based material such as epoxy resin, polyimide resin, and fluorine-based resin (typically, tetrafluoroethylene resin), and an organic resin-ceramic (also including glass) composite material.

Examples of a material for forming conductor portions in the wiring board 10, such as the line conductors 12A and 12B, the same plane grounding conductor layer 41, the internal grounding conductor layers 44 and 51, the first grounding conductor layer 13, the first and the second shield conductors 43 and 46, and the first to the sixth via-conductor portions 34, 35, 54, 55, 56 and 57, include a metallization material mainly containing tungsten, molybdenum, gold, silver, copper, or the like, and a metal foil mainly containing gold, silver, copper, aluminum, or the like, In particular, in the case where the waveguide converter is contained in the wiring board 10 on which a high-frequency part is mounted, it is desirable that the dielectric substrate 11 is made of a dielectric material that has a small dielectric loss tangent and that can realize a hermetic seal. Examples of a particularly desirable dielectric material include at least one inorganic material selected from the group consisting of aluminum oxide, aluminum nitride, and glass ceramic material. It is preferable that the dielectric substrate 11 is made of such a hard material, because the dielectric loss tangent is small and the mounted high-frequency part can be hermetically sealed, which improves the reliability of the mounted high-frequency part. In this case, it is desirable that, as the conductor material, a metallization conductor that can be fired at the same time as the dielectric material is used, in view of hermetic seal properties and productivity.

The above-described wiring board 10 is produced as follows. For example, in the case where an aluminum oxide-based sintered body is used as the dielectric material, first, an appropriate organic solvent or another solvent is added to and mixed with a material powder of aluminum oxide, silicon oxide, magnesium oxide, calcium oxide, or the like to form a slurry, this slurry is shaped into sheets using a conventionally well known doctor blade method or calendar roll method, and, thus, ceramic green sheets are produced. Furthermore, an appropriate organic solvent or another solvent is added to and mixed with a material powder of a high-melting-point metal such as tungsten or molybdenum, and, thus, a metallization paste is produced.

Next, the ceramic green sheets are processed using a processing method or the like, and, thus, through-holes for forming through conductors as the first and the second shield conductor portions 43 and 46, and the first to the sixth via-conductor portions 34, 35, and 54 to 57 are formed. Next, using a printing method or the like, the formed through-holes are filled with the metallization paste, and the metallization paste is printed in the shape of the line conductors 12A and 12B, the same plane grounding conductor layer 41, the internal grounding conductor layers 44 and 51, and the first grounding conductor layer 13. In the case where the dielectric substrate 11 has a layered structure including a plurality of dielectric layers, ceramic green sheets in which these conductors are embedded and printed are layered, pressure-bonded through application of a pressure, and fired at a high temperature (approximately 1600° C.). Furthermore, the conductors exposed on the surface, such as the line conductors 12A and 12B, the same plane grounding conductor layer 41, the first grounding conductor layer 13, or the like may be surface-treated so as to be nickel plated and gold plated.

The through conductors forming the first and the second shield conductor portions 43 and 46, and the first to the sixth via-conductor portions 34, 35, and 54 to 57 may be so-called via-conductors in which the through-holes are filled with a conductor, or may be so-called through-hole conductors in which a conductor layer is attached to the inner wall of the through-holes. Furthermore, the shield conductor portions 46, and the second and the fourth via-conductor portions 35 are 55 may be side-face conductors formed on the side face of the dielectric substrate 11, or castellation conductors.

Here, in the above-described example of the high-frequency modules 1B to 1F, the high-frequency line Ln has a coplanar line configuration, but may have a grounded coplanar line configuration in which another dielectric layer is layered on the dielectric substrate 11, and an upper-face grounding conductor layer is disposed on the upper face of this dielectric layer so as to cover the line conductor 12B. Also in this case, an effect as in the high-frequency modules 1B to 1F can be obtained by providing the dielectric substrate 11 with a choke structure.

There is no particular limitation on the shape of the waveguide 20. For example, when a WR series standardized as a square waveguide is used, a variety of calibration kits for measurement can be used, and, thus, various characteristics can be easily evaluated, but a square waveguide can be also used that is made smaller within the range in which cut-off of the waveguide is not generated, in order to reduce the size and weight of the system according to the frequency of a high-frequency signal used. Furthermore, a circular waveguide also can be used.

The waveguide 20 is preferably made of a metal, and the inner wall of the waveguide is preferably coated with a noble metal such as gold, silver, or the like in order to reduce a conductor loss or to prevent corrosion due to current. Furthermore, the waveguide 20 may be formed by shaping a resin into a desired waveguide shape, and the inner wall of the waveguide may be coated with a noble metal such as gold, silver, or the like as in the case of a metal. The waveguide 20 may be attached to the high-frequency line-waveguide converter by fixing using a conductive brazing filler metal, by screwing, or the like.

Here, the invention is not limited to the examples of the foregoing embodiments, and various changes are possible within the range not departing from the gist of the invention.

The invention claimed is:

1. A high-frequency module comprising:

a wiring board comprising a dielectric substrate, a line conductor that is formed on a first surface of the dielectric substrate, and a first grounding conductor layer that is formed on a second surface opposed to the first surface of the dielectric substrate, and that has a first opening and a second opening disposed around the first opening; and a waveguide that is connected to the second surface, has an opening opposed to the first opening, and is electromagnetically coupled to the line conductor, wherein the wiring board has a vertical choke portion, at least a part of which extends from the second opening in a direction perpendicular to the second surface, and a horizontal choke portion which is formed between the wiring board and the waveguide, along the second surface between the opening of the waveguide and the second opening, the wiring board further comprising:

a second grounding conductor layer that is disposed inside the dielectric substrate, and that has a third opening opposed to the first opening and a fourth opening opposed to the second opening; and a third grounding conductor layer that is disposed between the second grounding conductor layer and the first surface and inside the dielectric substrate, and that has a fifth opening opposed to the first opening;

the vertical choke portion comprises:

a first conductor portion that is disposed along an inner periphery of the second opening, and that connects the first grounding conductor layer and the second grounding conductor layer;

a second conductor portion that is disposed along an outer periphery of the second opening, and that connects the first grounding conductor layer and the second grounding conductor layer;

a third conductor portion that is disposed along an inner periphery of the fourth opening, and that connects the second grounding conductor layer and the third grounding conductor layer; and a fourth conductor portion that is disposed along an outer periphery of the fourth opening, and that connects the second grounding conductor layer and the third grounding conductor layer; and the second conductor portion and the fourth conductor portion are arranged vertically and electrically connected, and, in an extension direction of the line conductor, the third conductor portion is positioned farther away from the fourth opening than the first conductor portion.

2. The high-frequency module of claim 1, wherein the second opening is in a shape of a ring.

3. The high-frequency module of claim 2, wherein a distance between an outer periphery of the first opening and an inner periphery of the second opening is substantially ¼ an effective wavelength of a high-frequency signal transmitted through the line conductor, and a length of the vertical choke portion is substantially ¼ an effective wavelength of a high-frequency signal transmitted through the line conductor.

4. The high-frequency module of claim 1, wherein the wiring board has a fourth grounding conductor layer that is formed so as to surround one end portion of the line conductor, and that has a slot perpendicular to the one end portion of the line conductor, and the slot is inside the first opening.

5. A wiring board comprising:

a dielectric substrate;

a line conductor that is formed on a first surface of the dielectric substrate;

a first grounding conductor layer that is formed on a second surface opposed to the first surface of the dielectric substrate, that has a first opening and a second opening disposed around the first opening; and a vertical choke portion that is formed in the dielectric substrate, and that extends from the second opening in a direction perpendicular to the second surface, the wiring board comprises:

a second grounding conductor layer that is disposed inside the dielectric substrate, and that has a third opening opposed to the first opening and a fourth opening opposed to the second opening; and a third grounding conductor layer that is disposed between the second grounding conductor layer and the first surface and inside the dielectric substrate, and that has a fifth opening opposed to the first opening;

the vertical choke portion comprises:

a first conductor portion that is disposed along an inner periphery of the second opening, and that connects the first grounding conductor layer and the second grounding conductor layer;

a second conductor portion that is disposed along an outer periphery of the second opening, and that connects the first grounding conductor layer and the second grounding conductor layer;

a third conductor portion that is disposed along an inner periphery of the fourth opening, and that connects the second grounding conductor layer and the third grounding conductor layer; and a fourth conductor portion that is disposed along an outer periphery of the fourth opening, and that connects the second grounding conductor layer and the third grounding conductor layer; and the second conductor portion and the fourth conductor portion are arranged vertically and electrically connected, and, in the an extension direction of the line conductor, the third conductor portion is positioned farther away from the fourth opening than the first conductor portion.

6. The wiring board of claim 5, wherein the second opening is in a shape of a ring.

7. The wiring board of claim 6, wherein the wiring board has a fourth grounding conductor layer that is formed so as to surround one end portion of the line conductor, and that has a slot perpendicular to the one end portion of the line conductor, and the slot is inside the first opening.

8. The wiring board of claim 5, wherein a distance between an outer periphery of the first opening and an inner periphery of the second opening is substantially ¼ an effective wavelength of a frequency signal transmitted through the line conductor, and a length of the vertical choke portion is substantially ¼ an effective wavelength of a frequency signal transmitted through the line conductor.

* * * * *